US005912075A

United States Patent [19]

Yano et al.

[11] Patent Number: 5,912,075

[45] Date of Patent: Jun. 15, 1999

[54] MAGNETIC MARKER AND PROCESS FOR MANUFACTURING A ROLL HAVING A PLURALITY OF MAGNETIC MARKERS ARRANGED TRANSVERSELY THEREON

[75] Inventors: Nobuyoshi Yano; Shinji Furukawa; Kazuki Oka, all of Kyoto, Japan

[73] Assignee: Unitika Ltd., Hyogo, Japan

[21] Appl. No.: 08/627,997

[22] Filed: Apr. 4, 1996

[30] Foreign Application Priority Data

Apr. 13, 1995 [JP] Japan ..... 7-088017

[51] Int. Cl.[6] ..... H01F 1/00

[52] U.S. Cl. ..... 428/332; 428/458; 428/900

[58] Field of Search ..... 428/332, 458, 428/900

[56] References Cited

U.S. PATENT DOCUMENTS

| | | | |
|---|---|---|---|
| 5,083,112 | 1/1992 | Piotrowski et al. | 340/572 |
| 5,181,020 | 1/1993 | Furukawa et al. | 428/900 X |
| 5,405,702 | 4/1995 | Piotrowski et al. | 428/458 |

FOREIGN PATENT DOCUMENTS

| | | |
|---|---|---|
| A295028 | 12/1988 | European Pat. Off. . |
| A428262 | 5/1991 | European Pat. Off. . |
| A448114 | 9/1991 | European Pat. Off. . |
| A459722 | 12/1991 | European Pat. Off. . |

*Primary Examiner*—Henry F. Epstein
*Attorney, Agent, or Firm*—Sughrue, Mion, Zinn, Macpeak & Seas, PLLC

[57] ABSTRACT

A magnetic marker which comprises a flexible organic polymer substrate having an anisotropic thermal shrinking property and a soft magnetic thin film having uniaxial magnetic anisotropy. The angle formed between the direction in which the organic polymer substrate has the highest degree of thermal shrinkage and the direction of magnetic easy axis in the soft magnetic thin film is in the range from 50° to 90°. The marker is a thin film of a simple structure, yet exhibits satisfactory magnetic characteristics. A roll having a plurality of magnetic markers, each comprising an organic polymer substrate and a soft magnetic thin film formed transversely on the surface, can be manufactured by a process relying upon the combination of (i) a roll coater method and (ii) a sputtering technique. In the process, the organic polymer substrate is set and continuously transported such that the direction in which the organic polymer substrate experiences the highest degree of thermal shrinkage is not greater than 40° with respect to the direction of its travel. Furthermore, the thickness of the soft magnetic thin film that is deposited per unit of the cathode as the result of a single pass of the organic polymer substrate over the cathode does not exceed 0.4 μm. The process is capable of continuous production of magnetic markers having satisfactory magnetic characteristics and advantageously enables easy manufacture of a roll having a plurality of such magnetic markers arranged transversely thereon.

6 Claims, 10 Drawing Sheets

MAGNETIC MARKER AND PROCESS FOR MANUFACTURING A ROLL HAVING A PLURALITY OF MAGNETIC MARKERS ARRANGED TRANSVERSELY THEREON

FIELD OF THE INVENTION

This invention relates to a magnetic marker for use in electronic article surveillance systems. In such systems, an alternating magnetic field produced as an interrogatory signal in a surveillance area evokes an article surveillance signal from a magnetic marker affixed to articles that are being passed through the surveillance area. This invention also relates to a process for manufacturing a roll having a plurality of such markers arranged transversely on the surface of the roll.

BACKGROUND OF THE INVENTION

Electronic article surveillance systems have become commonplace in recent years as an effective tool for retail stores and libraries to protect against unpermitted removal of articles and books. For the identification of articles to be protected, these systems rely on a detection signal issued from a special marker affixed to said articles. There are several kinds of detection signals, and the selection of a suitable signal depends on the specific use. Methods of detection are roughly divided into the following three categories. The first approach utilizes a process which comprises magnetizing a special soft magnetic material. The second method makes use of an abrupt change in the impedance of an LC resonant circuit at a specified frequency. The third way concerns a signal transmission circuit that radiates special electric waves. Among these, the first method can supply markers at low cost and hence is predominantly used. While there are many versions of this method, they share a common feature in that the abrupt change which occurs in the magnetic properties of magnetic materials upon magnetization is detected in terms of a voltage induced in coils. Furthermore, the magnetic properties associated with the detection include magnetostrictive vibrations, high permeability characteristics and the squareness ratio of hysteresis characteristics.

In the early stage of their development, magnetic markers were of relatively large size in the form of ribbons or wires. However, recently, in order to increase the number of articles to which the markers can be affixed, namely to have the markers affixed to smaller articles, there has been a need to minimize the size of the markers. However, if an attempt at size reduction is simply applied to ribbons or wires, the effect of "demagnetizing field", or the tendency of a magnetic material to resist its own magnetization in the direction of an applied magnetic field, increases to thereby deteriorate the characteristics of the material as a magnetic marker. Hence, it has been difficult to reduce the size of markers in a ribbon or wire form.

Under these circumstances, thin films of various magnetic materials have been investigated in order to develop compact markers. For example, JP-A-4-232594 (the term "JP-A" as used herein means an "unexamined published Japanese patent application") corresponding to U.S. Pat. No. 5,083,112 discloses a marker in the form of a multilayered thin film comprising a plurality of magnetic thin films which are interposed by nonmagnetic thin films. Each magnetic thin film is separated from an adjacent magnetic thin film by a nonmagnetic thin film. As a result, magnetostatic coupling develops between adjacent magnetic thin films to sufficiently reduce the demagnetizing field and allow for size reduction of the marker. However, in order to fabricate the marker, magnetic thin films must alternate with nonmagnetic thin films, thus resulting in a complex structure. In addition, the thickness of each nonmagnetic thin film must be controlled with sufficient precision to assure that adjacent magnetic thin films will be coupled magnetostatically. However, this has often caused fluctuations in the magnetic characteristics of the fabricated markers.

Unexamined published Japanese patent application No. Hei. 5-502962 which is based on a PCT application (corresponding to U.S. Pat. No. 5,455,563) discloses a magnetic marker having a thin magnetic film in which the surface is modulated to thereby improve its magnetic characteristics. According to this method, a sharp blade is applied to a thin amorphous metal film on a polymer substrate such that flaws are made at given spacings, to thereby magnetically partition the thin metal film and to provide a magnetic marker having satisfactory characteristics. However, it is difficult to manufacture magnetic markers of satisfactory characteristics in a consistent manner by processing the surface of thin films by either mechanical or chemical means. Moreover, the magnetic characteristics of the marker are potentially deteriorated rather than improved.

JP-A-4-218905 (corresponding to U.S. Pat. No. 5,181,020) discloses that a small thin-film magnetic marker having satisfactory characteristics can be produced by depositing particles on a substrate to form a thin film. The substrate is spatially positioned relative to a target such that the subject particles are incident at an angle with respect to the substrate normal. In practice, magnetic markers having satisfactory magnetic characteristics can be obtained when thin magnetic films are fabricated on organic polymer substrates by this method. However, the magnetic characteristics fluctuate with the type of substrate that is used.

In most all cases in the prior art, markers are successively affixed to articles by means of a dispensing machine as they are peeled from the surface of a roll 1 as shown in FIG. 2. Therein, the roll 1 has a plurality of magnetic markers 2 arranged longitudinally on a film 3 furnished with a release paper. However, to realize faster dispensing, there is a growing demand today for "transverse markers", which are peeled from the surface of a roll 1 as shown in FIG. 1. Roll 1 of FIG. 1 has a plurality of magnetic markers 2 arranged transversely on a film 3 furnished with a release paper. Although the need is ever increasing not only for transverse markers in a ribbon or wire shape but also for those in a thin film shape, few studies have been made to meet this need. Still less has been described in the three prior patents discussed above.

The present inventors previously found that when an organic polymer substrate in which the absolute value of the difference in the degree of thermal shrinkage between longitudinal and transverse directions ranged from 0.003 to 0.015 was used as a substrate for preparing magnetic thin films, satisfactory uniaxial magnetic anisotropy could be obtained. The present inventors filed JP-A-7-220971 which describes an invention based on that finding. Magnetic markers fabricated from such thin films display fairly good magnetic characteristics. However, there was still a need for further improvement.

SUMMARY OF THE INVENTION

The present invention has been accomplished in view of the above circumstances. Thus, it is an object of the present invention to provide a thin-film magnetic marker having a simple structure and satisfactory magnetic characteristics.

Another object of the present invention is to provide a simple process for manufacturing a roll having a plurality of such magnetic markers that are transversely arranged on the surface of the roll.

In order to attain these objectives, the present inventors continued their studies and found that magnetic markers having satisfactory magnetic characteristics can be obtained from appropriate combinations of a flexible organic polymer substrate having an anisotropic thermal shrinking property and a soft magnetic thin film having uniaxial magnetic anisotropy. The present invention has been accomplished on the basis of this finding.

The present inventors also found that when the organic polymer substrate is set in such a way that the angle formed between the direction in which the substrate has the highest degree of thermal shrinkage and the direction of travel of said substrate is not greater than a specified value, and when the film-forming operation is carried out in such a way that the thickness of the soft magnetic thin film deposited per unit of a cathode as the result of a single pass of the organic polymer substrate over the cathode does not exceed a specified value, a roll can easily be manufactured having a plurality of magnetic markers with satisfactory characteristics that are transversely arranged on the surface of the substrate roll. The present invention has also been accomplished on the basis of this finding.

Thus, a first aspect of the present invention relates to a magnetic marker comprising a flexible, organic polymer substrate and a soft magnetic thin film, characterized in that the organic polymer substrate has an anisotropic thermal shrinking property whereas the soft magnetic thin film has uniaxial magnetic anisotropy. Furthermore, the angle formed between the direction in which the organic polymer substrate has the highest degree of thermal shrinkage and the direction of the magnetic easy axis in the soft magnetic thin film is in the range of from 50° to 90°.

A second aspect of this invention relates to a process for manufacturing a roll which has a plurality of magnetic markers, each comprising an organic polymer substrate and a soft magnetic thin film, formed transversely on the surface of the roll by means of a combination of (i) a roll coater method in which the organic polymer substrate that is set on a lead-on roll is continuously fed through a plurality of rolls as it is wound up by a take-up roll, and (ii) a sputtering technique in which a target placed within a cathode is sputtered in a gaseous atmosphere to deposit a thin film on the substrate. The process is further characterized in that the organic polymer substrate is set and transported for continuous travel in such a way that the direction in which the organic polymer substrate has the highest degree of thermal shrinkage is not greater than 40° with respect to the direction of travel. The process is also characterized in that the thickness of the soft magnetic thin film that is deposited per unit of the cathode as the result of a single pass of the organic polymer substrate over the cathode does not exceed 0.4 $\mu$m.

The magnetic marker according to the first aspect of this invention is a thin film of simple structure, yet exhibits satisfactory magnetic characteristics. The manufacturing process according to the second aspect of this invention allows for continuous production of magnetic markers having satisfactory magnetic characteristics. Furthermore, the manufacturing process advantageously enables easy manufacture of a roll having a plurality of such magnetic markers arranged transversely on the surface of the roll.

DETAILED DESCRIPTION OF THE INVENTION

Figure 1:
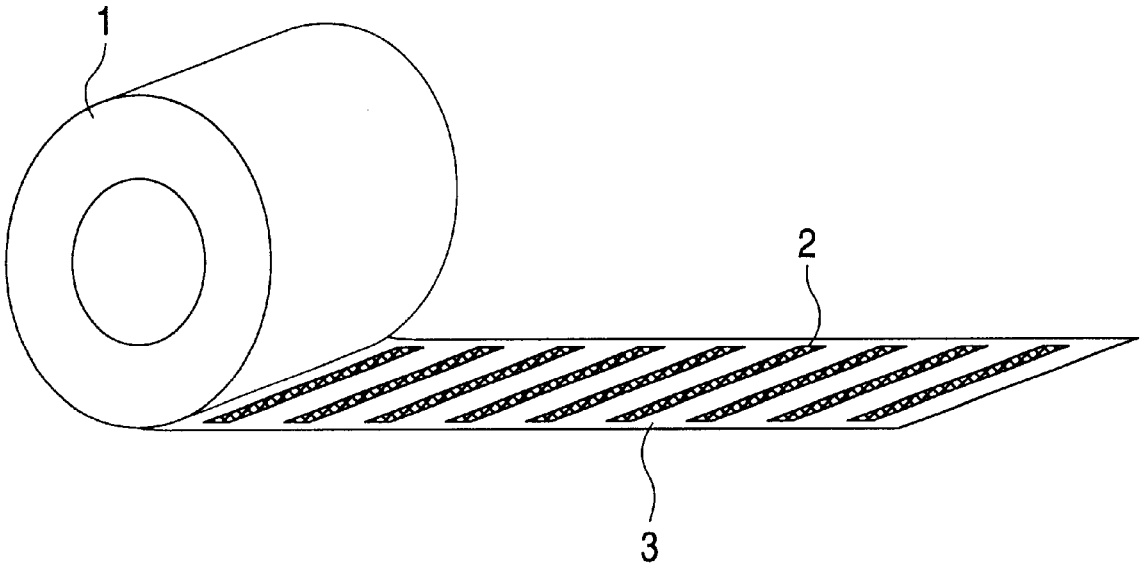
FIG. 1 is a perspective view schematically showing a roll having a plurality of magnetic markers arranged transversely on the surface of the roll.
Figure 2:
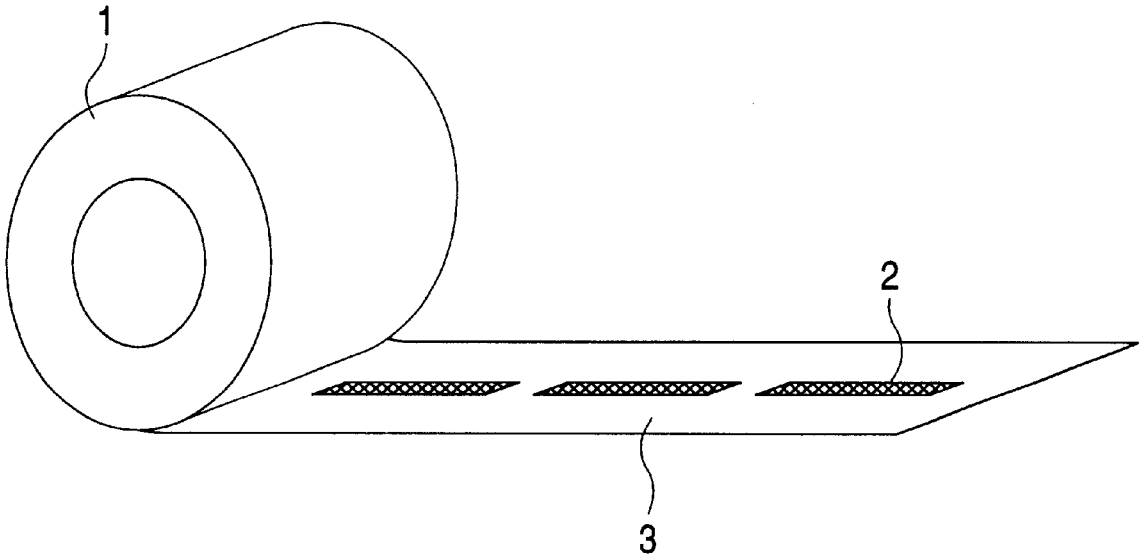
FIG. 2 is a perspective view schematically showing a roll having a plurality of magnetic markers arranged longitudinally on the surface of the roll.

The present invention will now be described in detail below.

The magnetic marker according to the first aspect of the invention has a simple structure in that a soft magnetic thin film is formed on a flexible, organic polymer substrate. To attain the objects of this invention, the organic polymer substrate necessarily has an anisotropic thermal shrinking property, whereas the soft magnetic thin film desirably has uniaxial magnetic anisotropy.

Also in this invention the two elements are spatially positioned such that the angle formed between the direction in which the organic polymer substrate has the highest degree of thermal shrinkage and the magnetic easy axis in the soft magnetic thin film ranges from 50° to 90°, preferably from 60° to 90°, more preferably from 75° to 90°. If the angle formed between the direction in which the organic polymer substrate has the highest degree of thermal shrinkage and the magnetic easy axis in the soft magnetic thin film is less than 50°, satisfactory magnetic anisotropy cannot be imparted to the soft magnetic thin film and the resulting magnetic marker will have poor characteristics.

The angle θ formed between the direction in which the organic polymer substrate has the highest degree of thermal shrinkage and the magnetic easy axis in the soft magnetic thin film is 0° if the direction of maximum thermal shrinkage is parallel to the magnetic easy axis. The angle θ increases as the relationship departs from a parallel orientation and reaches 90° when the direction of maximum thermal shrinkage is normal to the magnetic easy axis. Therefore, the state in which the direction of maximum thermal shrinkage forms an angle θ with the magnetic easy axis is equivalent to the state where they form an angle of 180° minus θ. For example, the state where θ is 40° is equivalent to the state where θ is 140°. Hence, the relative positional relationship between the direction in which the organic polymer substrate has the highest degree of thermal shrinkage and the magnetic easy axis in the soft magnetic thin film is specified by an angle θ of from 0° to 90°, and the maximum value that can be assumed by θ is 90°.

When maximum and minimum values for the degree of thermal shrinkage α that occurs in the organic polymer substrate as a result of heat treatment at 150° C. for 15 minutes is expressed by αMAX and αMIN, respectively, the difference between these two values may be taken as a figure of merit for the performance of the magnetic marker that uses the organic polymer substrate. Preferably, the substrate has a value of from 0.003 to 0.015 in terms of αMAX–αMIN because the resulting magnetic marker has improved magnetic characteristics. More preferably, the value of αMAX–αMIN ranges from 0.006 to 0.01.

The degree of thermal shrinkage that occurs in the organic polymer substrate can be varied by adjusting the conditions of substrate preparation, and it can also be varied by heat treating the substrate. Therefore, as long as the difference between maximum and minimum values for the degree of thermal shrinkage α that occurs in the organic polymer substrate as a result of heat treatment at 150° C. for 15 min. ranges from 0.003 to 0.015, the substrate may be used as prepared, or may be subsequently heated or otherwise treated.

For measuring the degree of thermal shrinkage, the method described in JIS C2318 may be employed except that the heating time of a sample is changed to 15 min. Stated specifically, five test pieces 20 mm wide and 150 mm long are cut, and each is provided with two markings in the center at a spacing of 100 mm. The test pieces are then left to stand in a thermostated vessel at 150° C. for 15 min. and thereafter the distance between the two markings is measured. The measurement is conducted for the five test pieces in a total of 12 directions, both longitudinally and transversely, which are varied on a pitch of 15°. The degree of thermal shrinkage is calculated by the following equation (1), and the average is taken for the five samples to determine the degree of thermal shrinkage a in each of the 12 stated directions. From the data thus obtained, αMAX (maximum α) and αMIN (minimum α) are selected to determine the direction in which the organic polymer substrate has the highest degree of thermal shrinkage.

$$\alpha = \frac{L_1 - L_2}{L_1} \quad (1)$$

where $L_1$ is the distance between the markings before heating and $L_2$ is the distance between the markings after heating.

The organic polymer substrate for use in the present invention is not particularly limited as long as it is flexible. Useful examples thereof include polyester films such as polyethylene terephthalate (PET), 2,6-polyethylene naphthalate (PEN) and polyarylate (PAR), polyamide films such as nylon 6, nylon 66 and nylon 12, polyphenylene sulfide (PPS) films, unstretched amorphous resin films such as polysulfone (PSF) and polyether sulfone (PES), as well as polyimide (PI) films, polypropylene (PP) films and wholly aromatic polyamide (APA) films. Among these, polyethylene terephthalate (PET) films are preferably used for economic reasons.

The organic polymer substrate preferably has a thickness of from 25 to 125 μm, with the range of from 50 to 100 μm being particularly preferred. Organic polymer substrates thinner than 25 μm are often difficult to handle. If the thickness of the substrate exceeds 125 μm, the curvature that the substrate acquires during rolling is difficult to eliminate even by detaching individual magnetic markers from the surface of the roll. Therefore, substrates thicker than 125 μm are not suitable for use on magnetic markers.

The soft magnetic thin film for use in the present invention is not particularly limited as long as it has uniaxial magnetic anisotropy. Preferably, the soft magnetic thin film contains an amorphous phase which can acquire uniaxial anisotropy with comparative ease, and more preferably it contains at least 50% of such an amorphous phase. From an economic viewpoint, Fe-based thin films are desirable. Furthermore, while various compositions are known to be capable of providing an Fe-based amorphous phase, as exemplified by Fe-Si-B, Fe-P-B, Fe-P-C and Fe-Zr, thin films containing C are particularly preferred from an economic viewpoint. For example, Fe-C based thin films may be prepared by reactive sputtering in a gaseous atmosphere consisting of a mixture of an inert gas and an unsaturated hydrocarbon gas, and the thus prepared Fe-C based thin films allow for more economical fabrication of magnetic markers having satisfactory magnetic characteristics. The target for use in reactive sputtering is in no way limited to pure Fe or Fe-C only, and commercial steel species that contain not only Fe and C but also other elements, such as carbon tool steels, alloy tool steels, high-speed steels and cast iron, may be used after being worked to the shape of the target.

Furthermore, as long as the requirement for uniaxial magnetic anisotropy is satisfied, a Co- or Ni-based thin film that is prepared by reactive sputtering in a gaseous atmosphere consisting of a mixture of an inert gas and an unsaturated hydrocarbon gas may be used as the soft magnetic thin film.

To acquire uniaxial magnetic anisotropy, a magnetic field maybe applied to the soft magnetic thin film as it grows during the process of thin-film formation, or the conditions of film formation may be appropriately controlled.

Magnetic thin film preferably has a thickness of from 0.1 to 3 μm, with the range of from 0.2 to 2 μm being particularly preferred. If the thickness of magnetic thin film is below 0.1 μm, it doesn't exhibit an excellent soft magnetic property. On the other hand, when the thickness of magnetic thin film exceeds 3 μm, it doesn't exhibit an excellent uniaxial anisotropy. Therefore, magnetic thin film thinner than 0.1 μm and thicker than 3 μm are not suitable for use on magnetic markers.

The second aspect of the invention relates to a process for manufacturing a roll having a plurality of the above-described magnetic markers arranged transversely on the surface thereof. The process will now be described below.

The roll shown in FIG. 1 which has a plurality of magnetic markers according to the first aspect of this invention arranged transversely on the surface of the roll can be manufactured by combining a roll coater method with a sputtering technique. The roll coater method is implemented with a roll coater comprising three basic components, namely, a lead-on roll, a take-up roll and a cylindrical main roll. A continuous web of the organic polymer substrate which has been set on the lead-on roll is continuously fed through a plurality of rolls and successively wound up with the take-up roll. A magnetic thin film is deposited on the substrate while it is in contact with the surface of the main roll.

The sputtering technique is such that a target placed within a cathode is sputtered in a gaseous atmosphere to deposit a thin film on the substrate.

When fabricating the magnetic marker by a combination of the roll coater method and the sputtering technique, the organic polymer substrate is continuously transported. Also, the substrate is set in such a way that the direction in which the substrate has the highest degree of thermal shrinkage forms an angle of not more than 40° with the direction of travel of the substrate. Preferably, the direction of maximum thermal shrinkage forms an angle of not more than 20° with the direction of travel of the substrate, and most preferably the subject angle is 0°. If the angle the direction of maximum thermal shrinkage forms with the direction of substrate's travel exceeds 40°, the magnetic easy axis in the soft magnetic thin film is offset to a great extent from the transverse direction of the substrate. As a result, the magnetic markers arranged transversely on the surface of a roll will not have the intended uniaxial magnetic anisotropy, and hence will exhibit poor characteristics.

The angle θ formed between the direction in which the organic polymer substrate has the highest degree of thermal shrinkage and the direction of travel of the substrate is 0° if the direction of maximum thermal shrinkage is parallel to the direction of travel of the substrate. The angle θ increases as the relationship departs from a parallel orientation and reaches 90° when the direction of maximum thermal shrinkage is normal to the direction of travel of the substrate. Therefore, the state in which the direction of maximum thermal shrinkage forms an angle θ with the direction of travel of the substrate is equivalent to the state where they form an angle of 180° minus θ. For example, the state where θ is 40° is equivalent to the state where θ is 140°. Hence, the positional relationship between the direction in which the organic polymer substrate has the highest degree of thermal shrinkage and the direction of travel of the substrate is specified by an angle θ of from 0° to 90°, and the maximum value that can be assumed by θ is 90°.

When fabricating the magnetic marker by a combination of the roll coater method and the sputtering technique, the thickness of the soft magnetic thin film that is deposited per unit of the cathode as the result of a single pass of the organic polymer substrate over the cathode should not exceed 0.4 μm. The preferred thickness is 0.2 μm or below. If the thickness of the soft magnetic thin film that is deposited per unit of the cathode as the result of a single pass of the organic polymer substrate over the cathode exceeds 0.4 μm, the resulting thin film not only has deteriorated soft magnetic material characteristics but also does not exhibit satisfactory uniaxial magnetic anisotropy.

A soft magnetic thin film thicker than 0.4 μm may be prepared by passing the organic polymer substrate several times over the cathode while ensuring that a film no thicker than 0.4 μm forms per unit of the cathode as the result of a single pass of the substrate over the cathode.

To implement the manufacturing process of the invention, a continuous web of the organic polymer substrate is first set on the lead-on roll from which it is delivered and transported for continuous travel. A soft magnetic thin film is deposited on the substrate while the substrate is in contact with the surface of the cylindrical main roll. To this end, one or more units of the cathode may be provided under the main roll.

The sputtering apparatus used to fabricate the soft magnetic thin film having uniaxial magnetic anisotropy in the present invention is not particularly limited, and useful examples are an r-f diode sputtering apparatus, a d-c sputtering apparatus, a magnetron sputtering apparatus, a triode sputtering apparatus and an ion-beam sputtering apparatus, as well as a sputtering apparatus having opposed targets. Among these, a magnetron sputtering apparatus is advantageously used with those organic polymer films having relatively low heat resistance since they permit faster deposition rates of thin films while effectively retarding elevation of the substrate temperature.

In magnetron sputtering, an electric field is applied to the target as a cathode, and a magnetic field is applied in a direction normal to the electric field so as to cause the cyclotron movement of the charged particles in plasma. This improve the sputtering yield, and the particles of the sputtered target are deposited on the substrate.

The magnetic field that is applied to cause the cyclotron movement of the charged particles may be supplied in the form of a leakage field from a permanent magnet or an electromagnet that is placed beneath the target. Alternatively, a yoke may be connected to the permanent magnet or electromagnet such that a magnetic flux is directly induced above the target surface to thereby enhance the leakage field.

The conditions for preparing a soft magnetic thin film in a gaseous atmosphere vary with the size of the deposition chamber and the evacuating capacity of the vacuum pump that is used. The ultimate vacuum to be reached within the deposition chamber during thin film formation is preferably $5\times10^{-6}$ torr or below, more preferably $1\times10^{-6}$ torr or below. A mixture of an inert gas and an unsaturated hydrocarbon gas is preferably used as the gas that is supplied to the vacuum chamber during thin film formation. Examples of the inert gas include argon, helium and neon. A commercially available unsaturated hydrocarbon gas is acceptable, and examples thereof include acetylene, allene, isobutylene, ethylene, 1,3-butadiene, 1-butene, propylene and methyl acetylene. The inert gas is suitably set to a flow rate of from 20 to 200 CCM, preferably from 40 to 170 CCM, more preferably from 60 to 150 CCM. The unsaturated aromatic hydrocarbon gas is suitably set to a flow rate of from 0.5 to 30 CCM, preferably from 2 to 25 CCM, more preferably from 5 to 20 CCM.

The following Examples and Comparative Examples are provided for the purpose of further illustrating the present invention, but are in no way to be taken as limiting.

EXAMPLE 1

A continuous thin Fe-C film was deposited in a thickness of 0.4 μm on a substrate by means of a d-c magnetron sputtering apparatus. The substrate was a square polyethylene terephthalate film (UNITIKA, LTD.) 100 μm thick and 100 mm long on each side. For film deposition, permanent magnets were placed on both sides of the substrate such that the magnets were substantially normal to the direction in which the substrate had the highest degree of thermal shrinkage. Iron (99.9% pure) was used as a target for sputtering which was conducted in a gaseous mixture of Ar (flow rate: 150 CCM) and $C_2H_4$ (15 CCM) at a sputtering gas pressure of $1.5\times10^{-3}$ torr with sputtering power supplied at 7 kW.

The magnetic easy axis in the deposited thin Fe-C film formed an angle of 85° with the direction in which the substrate (polyethylene terephthalate film) had the highest degree of thermal shrinkage.

Figure 3:
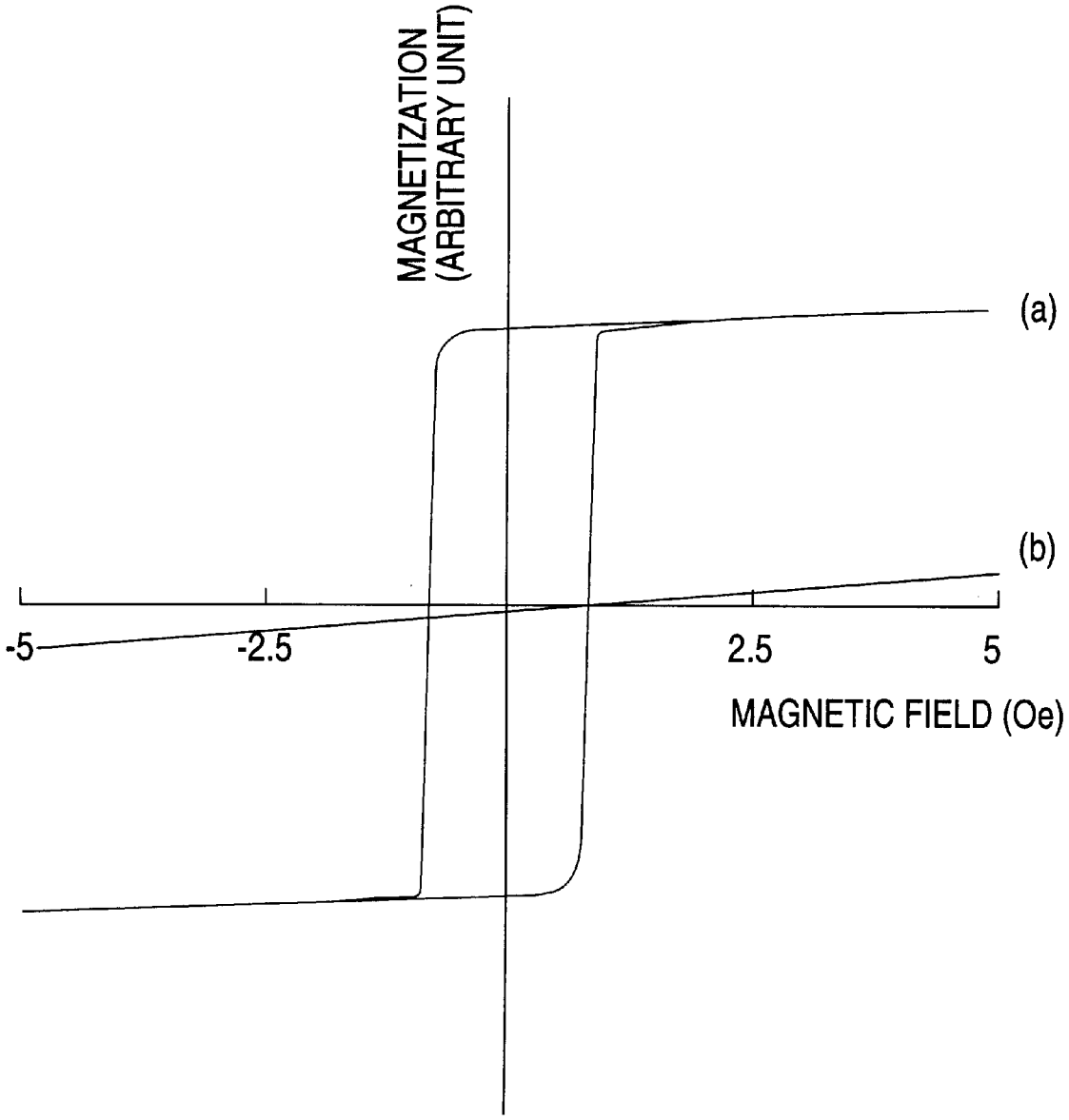
FIG. 3 shows two magnetization curves (a) and (b) for the magnetic easy and hard axes in the thin film prepared in Example 1, respectively.

The cyclic magnetization characteristics of the thin Fe-C film were measured with a magnetic hysteresis loop tracer AC BH-100K (Riken Denshi Co., Ltd.) at a frequency of 60 Hz. The results are shown in FIG. 3, which plots the applied magnetic field on the horizontal axis and the degree of magnetization on the vertical axis. Curve (a) shows the magnetization that developed along the magnetic easy axis, and curve (b) shows the magnetization along the magnetic hard axis. As seen from FIG. 3, a loop of high squareness ratio having a coercive force of 0.6 Oe was obtained along the magnetic easy axis, whereas the magnetization changed linearly with the applied field along the magnetic hard axis. Thus, the thin Fe-C film acquired a very high degree of uniaxial magnetic anisotropy.

The structure of the thin film was identified with an X-ray diffractometer RAD-RB (Rigaku Denki Co., Ltd), and it exhibited a halo pattern characteristic of amorphous structures.

Figure 4:
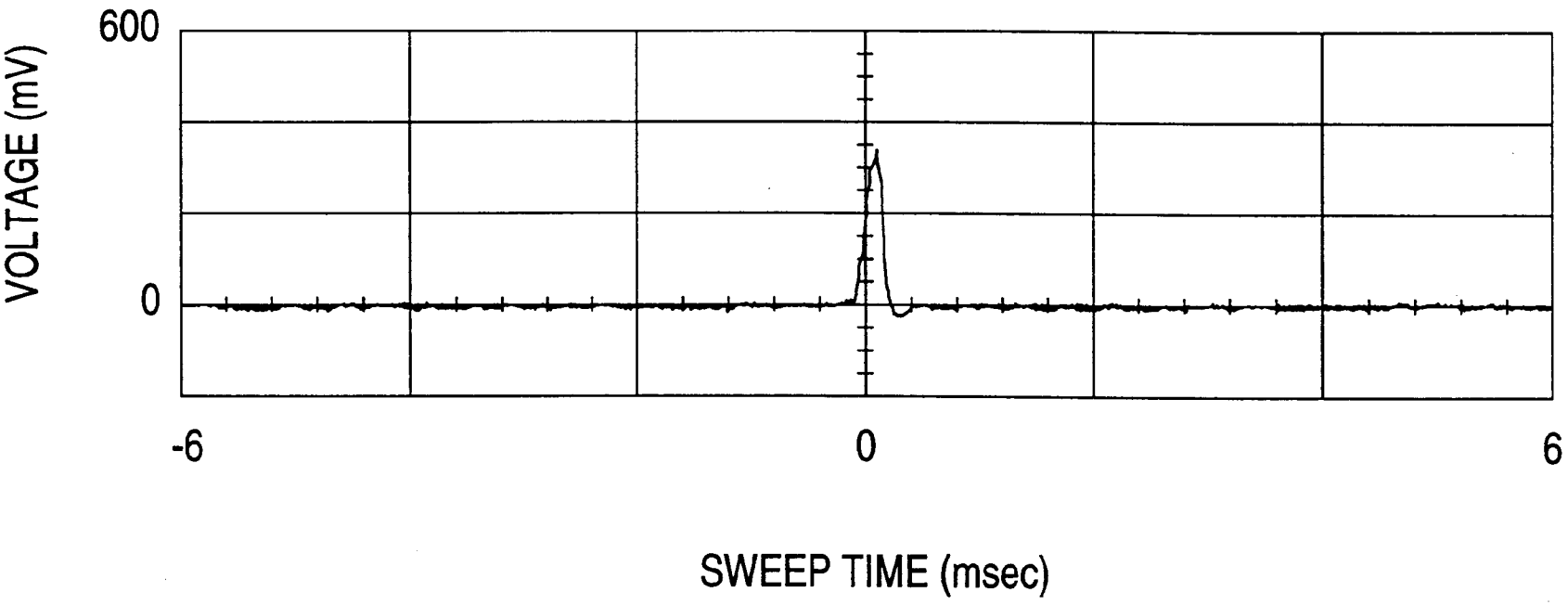
FIG. 4 shows pulse voltage that were generated when an a-c magnetic field was applied to the thin film prepared in Example 1.

To evaluate its performance as a magnetic marker, the thin film was cut to a rectangular shape 5 mm wide and 30 mm long such that the magnetic easy axis was aligned in the longitudinal direction, and a cyclic magnetic field of 1.5 Oe was applied at 60 Hz. The resulting pulse voltage were measured in terms of the voltage that was induced at a detection coil wound about the thin film. The results are shown in FIG. 4, which plots the sweep time on the horizontal axis and the voltage on the vertical axis. As seen from FIG. 4, the magnetic marker prepared in Example 1 had a sharp pulse characteristic, thus indicating its superior magnetic characteristics.

EXAMPLE 2

A continuous thin Fe-C film was deposited in a thickness of 0.3 $\mu$m on a substrate by means of a d-c magnetron sputtering apparatus. The substrate was a square polyethylene terephthalate film (UNITIKA, LTD.) that was 75 $\mu$m thick and 100 mm long on each side. The difference between $\alpha$MAX and $\alpha$MIN was 0.007, with $\alpha$MAX and $\alpha$MIN being maximum and minimum values, respectively, for the degree of thermal shrinkage a that occurred as a result of heat treatment at 150° C. for 15 min. A commercial alloy tool steel (JIS designation: SKS 3) was used as a target for sputtering which was conducted in a gaseous mixture of Ar (flow rate: 150 CCM) and $C_2H_4$ (15 CCM) at a sputtering gas pressure of $1.5\times10^{-3}$ torr with sputtering power supplied at 7 kW.

The magnetic easy axis in the deposited thin Fe-C film formed an angle of 75° with the direction in which the substrate (polyethylene terephthalate film) had the highest degree of thermal shrinkage.

Figure 5:
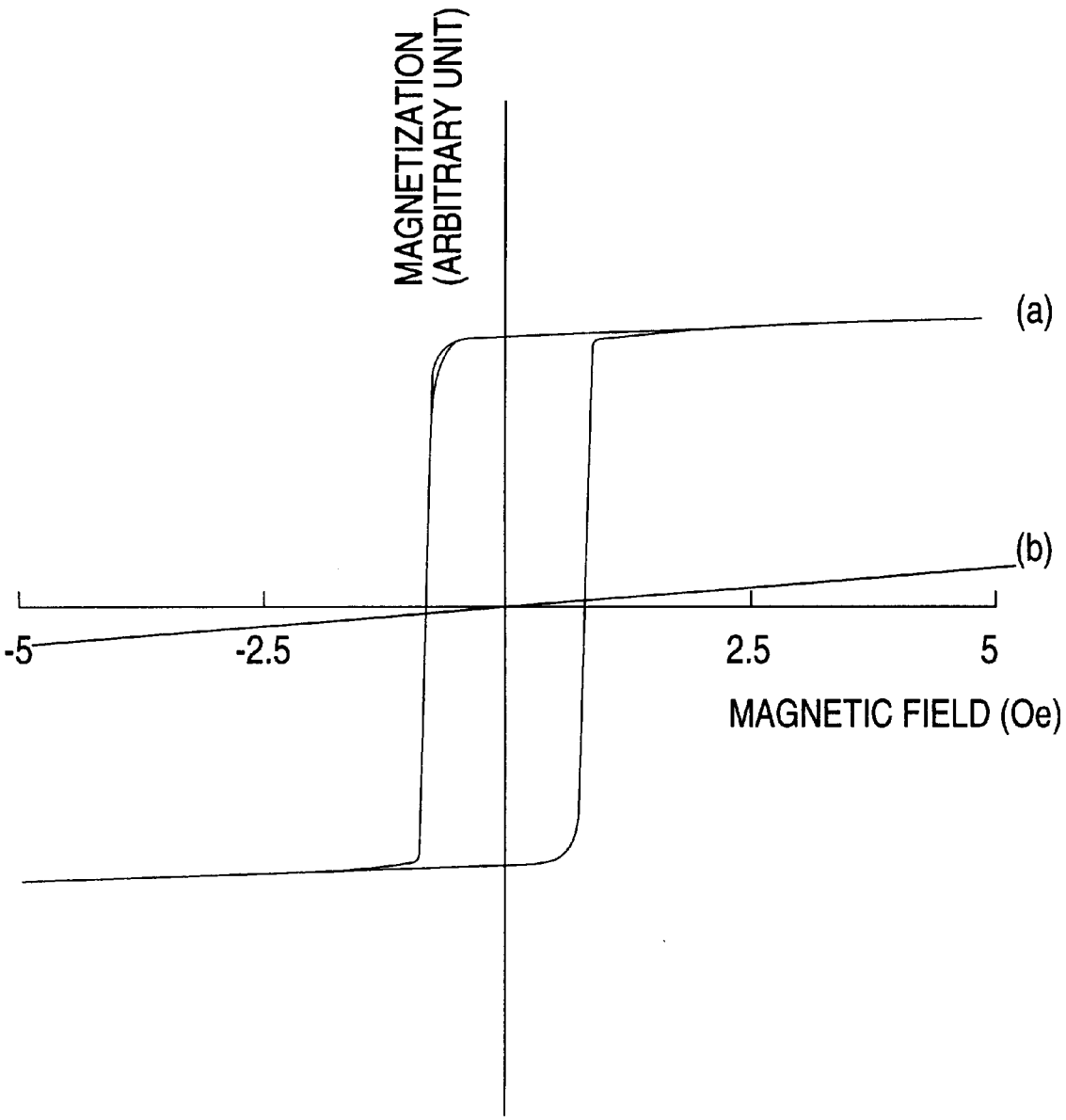
FIG. 5 shows two magnetization curves (a) and (b) for the magnetic easy and hard axes in the thin film prepared in Example 2, respectively.

The cyclic magnetic characteristics of the thin Fe-C film were measured as in Example 1. The results are shown in FIG. 5, which plots the applied magnetic field on the horizontal axis and the degree of magnetization on the vertical axis. Curve (a) shows the magnetization that developed along the magnetic easy axis, and curve (b) shows the magnetization along the magnetic hard axis. As seen from FIG. 5, a loop of high squareness ratio having a coercive force of 0.6 Oe was obtained along the magnetic easy axis, whereas the magnetization changed linearly with the applied field along the magnetic hard axis. Thus, the thin Fe-C film acquired a degree of uniaxial magnetic anisotropy that was as high as that of the thin film prepared in Example 1.

The structure of the thin film was identified by the same method as in Example 1, and it exhibited a halo pattern characteristic of amorphous structures.

Figure 6:
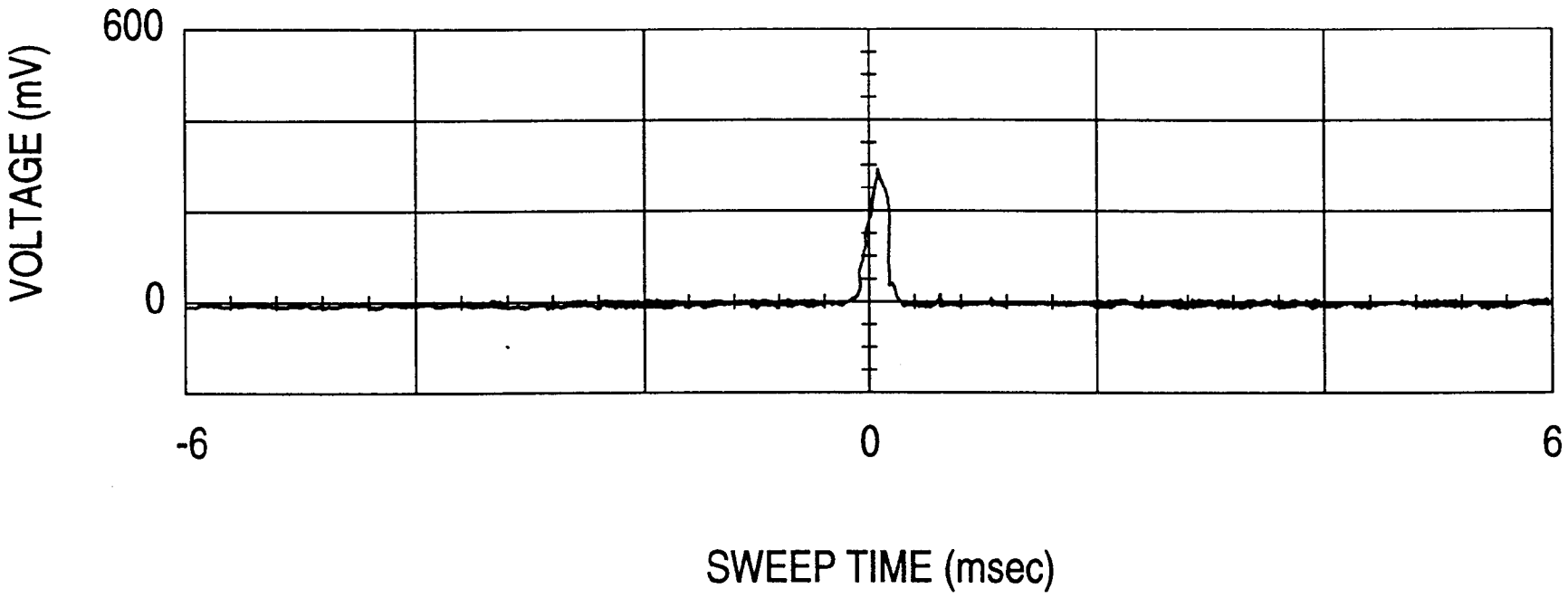
FIG. 6 shows pulse voltage that were generated when an a-c magnetic field was applied to the thin film prepared in Example 2.

To evaluate its performance as a magnetic marker, the thin film was cut to a rectangular shape 5 mm wide and 30 mm long such that the magnetic easy axis was aligned in the longitudinal direction. The pulse voltage that developed upon field application as in Example 1 were measured in terms of the voltage that was induced at a detection coil wound about the thin film. The results are shown in FIG. 6, which plots the sweep time on the horizontal axis and the voltage on the vertical axis. As seen from FIG. 6, the magnetic marker prepared in Example 2 also had a sharp pulse characteristic, thus indicating its superior magnetic characteristics.

EXAMPLE 3

A continuous thin Fe-Si-B-C film was deposited in a thickness of 0.4 $\mu$m on a substrate by means of a d-c magnetron sputtering apparatus. The substrate was a square polyethylene terephthalate film (UNITIKA, LTD.) that was 100 $\mu$m thick and 100 mm long on each side. The difference between $\alpha$MAX and $\alpha$MIN was 0.01, with $\alpha$MAX and $\alpha$MIN being maximum and minimum values, respectively, for the degree of thermal shrinkage a that occurred as a result of heat treatment at 150° C. for 15 min. For film deposition, permanent magnets were placed on both sides of the substrate such that the magnets were substantially normal to the direction in which the substrate had the highest degree of thermal shrinkage. An alloy system Fe-Si-B was used as a target for sputtering which was conducted in a gaseous mixture of Ar (flow rate: 200 CCM) and $C_3H_6$ (10 CCM) at a sputtering gas pressure of $2.0\times10^{-3}$ torr with sputtering power supplied at 8 kW.

The magnetic easy axis in the deposited thin Fe-Si-BC film formed an angle of 65° with the direction in which the substrate (polyethylene terephthalate film) had the highest degree of thermal shrinkage.

The cyclic magnetic characteristics of the thin FeSi-B-C film were measured as in Example 1. A loop of high squareness ratio having a coercive force of 0.3 Oe was obtained along the magnetic easy axis, whereas the magnetization changed linearly with the applied field along the magnetic hard axis. Thus, the thin Fe-Si-B-C film acquired a degree of uniaxial magnetic anisotropy that was as high as that of the thin film prepared in Example 1.

The structure of the thin film was identified by the same method as in Example 1, and it exhibited a halo pattern characteristic of amorphous structures.

To evaluate its performance as a magnetic marker, the thin film was cut to a rectangular shape 5 mm wide and 30 mm long such that the magnetic easy axis was aligned in the longitudinal direction. The pulse voltage that developed upon field application as in Example 1 were measured in terms of the voltage that was induced at a detection coil wound about the thin film. The magnetic marker prepared in Example 3 also had a sharp pulse characteristic, thus indicating its superior magnetic characteristics.

COMPARATIVE EXAMPLE 1

A continuous thin Fe-C film was deposited in a thickness of 0.4 $\mu$m on a polyethylene terephthalate film of the same dimensions as in Example 1 using a d-c magnetron sputtering apparatus. For film deposition, permanent magnets were placed on both sides of the substrate such that the magnets formed an angle of 30° with the direction in which the substrate had the highest degree of thermal shrinkage. The target and sputtering conditions were the same as in Example 1.

The magnetic easy axis in the deposited thin Fe-C film formed an angle of 40° with the direction in which the substrate (polyethylene terephthalate film) had the highest degree of thermal shrinkage.

Figure 7:
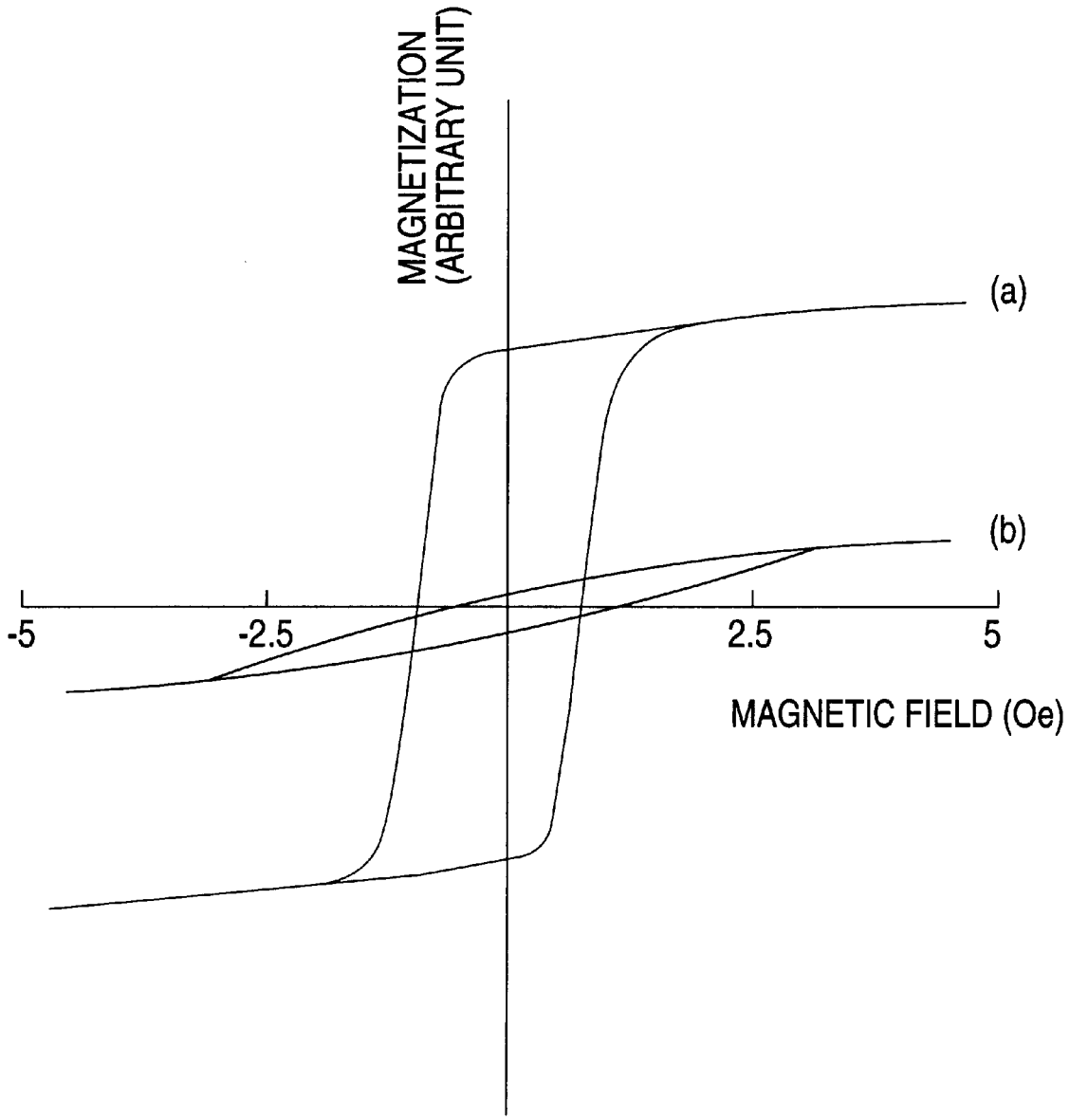
FIG. 7 shows two magnetization curves (a) and (b) for the magnetic easy and hard axes in the thin film prepared in Comparative Example 1, respectively.

The cyclic magnetization characteristics of the thin Fe-C film were measured as in Example 1. The results are shown in FIG. 7, which plots the applied magnetic field on the horizontal axis and the degree of magnetization on the vertical axis. Curve (a) shows the magnetization that developed along the magnetic easy axis, and curve (b) shows the magnetization along the magnetic hard axis. The film exhibited a soft magnetic characteristic (0.7 Oe) along the magnetic easy axis but a loop of high squareness ratio was not obtained. Moreover, the magnetization did not linearly change with the applied field along the magnetic hard axis, indicating that the film did not acquire satisfactory uniaxial magnetic anisotropy.

To evaluate its performance as a magnetic marker, the thin film was cut to a rectangular shape 5 mm wide and 30 mm long such that the magnetic easy axis was aligned in the longitudinal direction, and the pulsed voltage that developed upon field application as a Example 1 were measured in terms of the voltage that was induced at a detection coil wound about the thin film. A satisfactory pulsed voltage was not obtained under the stated conditions. Hence, the magnetic marker of Comparative Example 1 did not have satisfactory magnetic characteristics.

EXAMPLE 4

A continuous Fe-C film 50 m long was deposited in a thickness of 0.5 $\mu$m on a polyethylene terephthalate substrate film 75 $\mu$m thick and 100 cm wide (UNITIKA, Ltd.) by a roll coater method with a d-c magnetron sputtering apparatus. The film was set on a lead-on roll such that the direction in which the film had the highest degree of thermal shrinkage formed an angle of 0° with (i.e., was parallel to) the direction of its travel, and the film was continuously transported over a cylindrical main roll. A single unit cathode was placed beneath the main roll, and the thickness of the Fe-C film that was deposited as the result of a single pass of the substrate over the cathode was set at 0.05 $\mu$m. The substrate was passed over the cathode 10 times to provide a final film thickness of 0.5 $\mu$m. Iron (99.9% pure) was used as a target for sputtering which was conducted in a gaseous mixture of Ar (flow rate: 150 CCM) and $C_2H_4$ (20 CCM) at a sputtering gas pressure of $1.8\times10^{-3}$ torr with sputtering power supplied at 8 kW.

The magnetic easy axis in the deposited thin Fe-C film formed an angle of 85° with the direction of substrate travel (i.e., the direction of its maximum thermal shrinkage).

Figure 8:
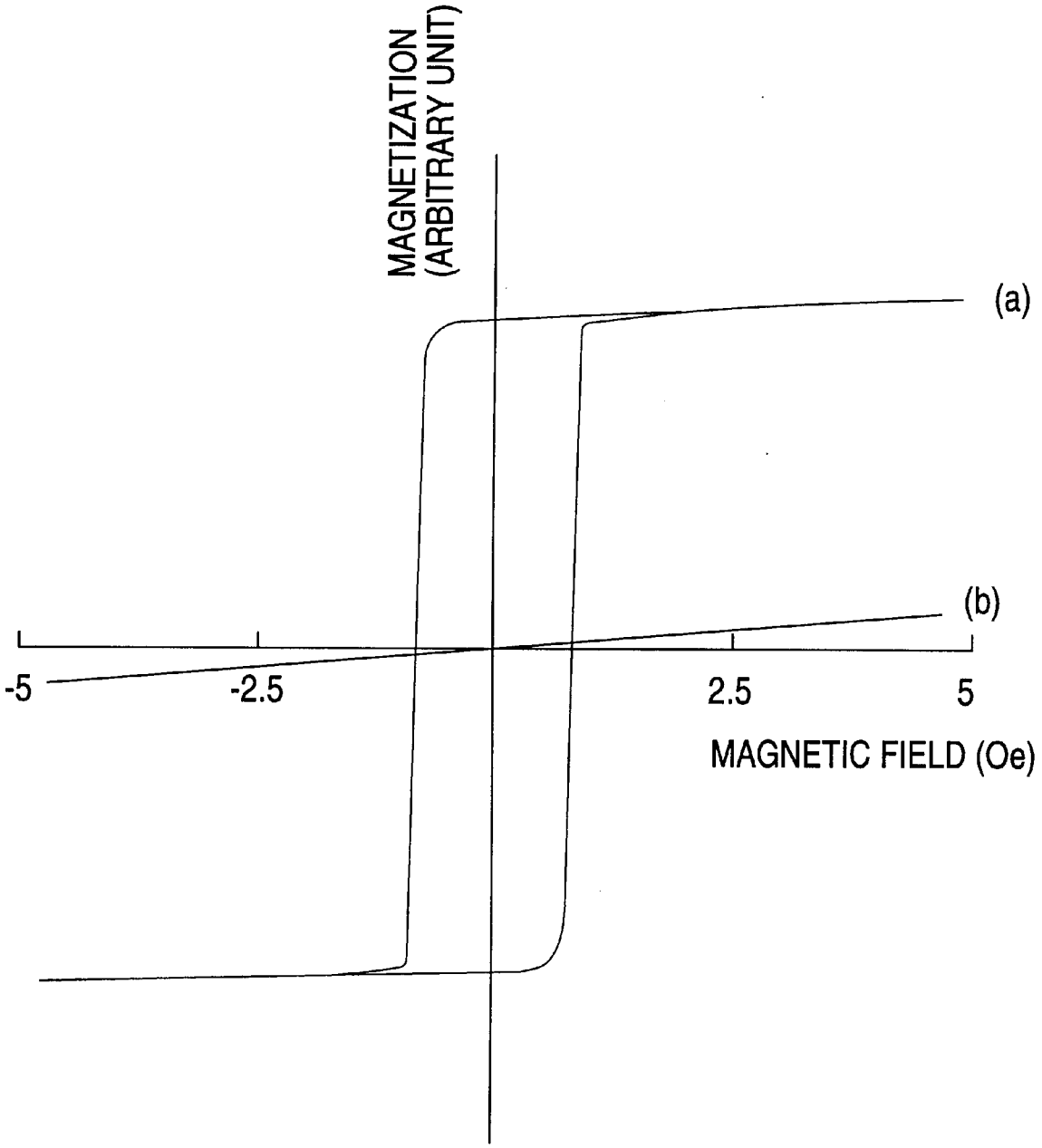
FIG. 8 shows two magnetization curves (a) and (b) for the thin film of Example 4 in the transverse and longitudinal directions of the substrate, respectively.

The cyclic magnetic characteristics of the thin Fe-C film were measured as in Example 1. The results are shown in FIG. 8, which plots the applied magnetic field on the horizontal axis and the degree of magnetization on the vertical axis. Curve (a) shows the magnetization that developed in the transverse direction of the substrate, and curve (b) shows the magnetization in the longitudinal direction. As seen from FIG. 8, the deposited film acquired a magnetic easy axis in the transverse direction of the substrate, to thereby produce a loop of high squareness ratio having a coercive force of 0.5 Oe. On the other hand, the magnetization in the longitudinal direction of the substrate changed linearly with the applied field. Thus, the thin Fe-C film acquired a very high degree of uniaxial magnetic anisotropy.

The structure of the thin film was identified by the same method as in Example 1, and it exhibited a halo pattern characteristic of amorphous structures.

Figure 9:
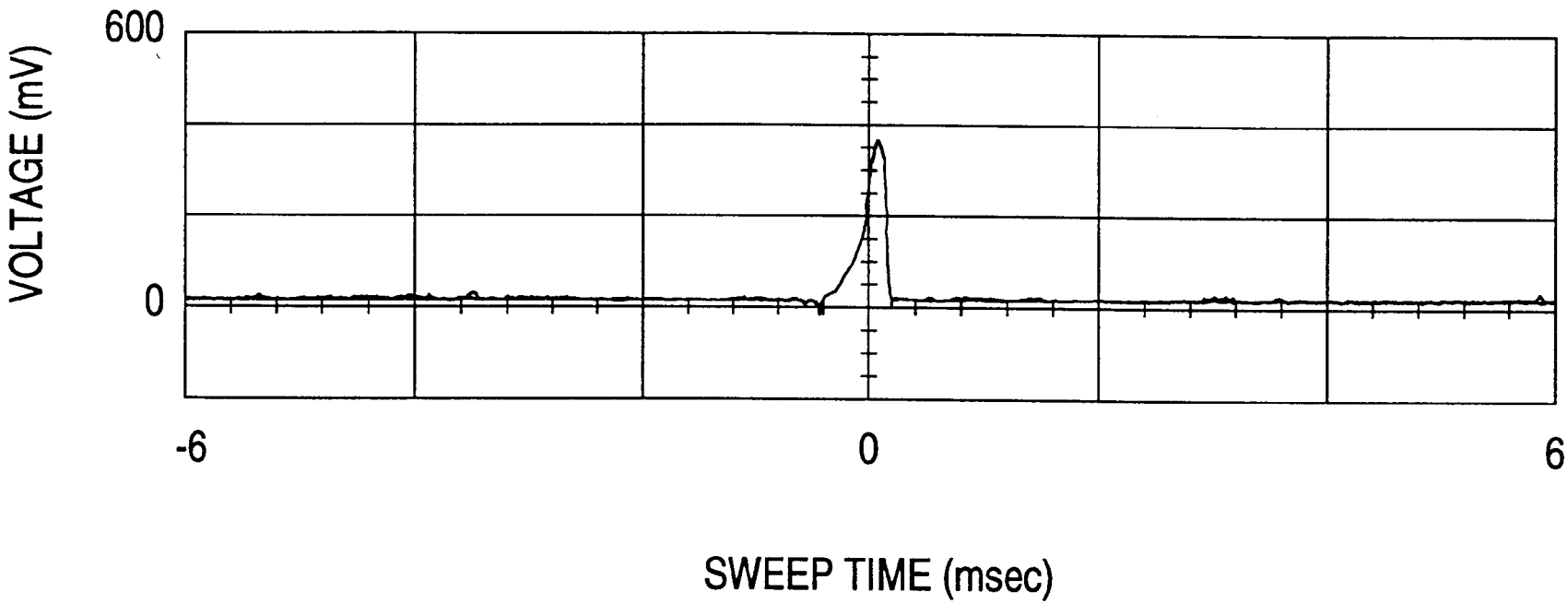
FIG. 9 shows pulse voltage that were generated when an a-c magnetic field was applied to the thin film prepared in Example 4.

For the ultimate purpose of obtaining a plurality of magnetic markers arranged transversely as shown in FIG. 1, a sample 5 mm wide and 30 mm long was cut out of the continuous thin Fe-C film such that the sample width (as measured in the transverse direction) was oriented parallel to the longitudinal direction of the thin film (i.e., the direction of substrate travel). The pulse voltage that developed upon field application as in Example 1 were evaluated in terms of the voltage that was induced at a detection coil wound about the thin film. The results are shown in FIG. 9, which plots the sweep time on the horizontal axis and the voltage on the vertical axis. As seen from FIG. 9, the magnetic marker prepared in Example 4 had a sharp pulse characteristic, thus indicating its superior magnetic characteristics. In another experiment, 10 samples were taken at spacings of 5 m along the length of the thin film (parallel to the travel path of the substrate) and evaluated for pulse characteristics by the same method. Each sample had a sharp pulse characteristic that was almost comparable to all the other samples. Thus, a roll was manufactured having a plurality of magnetic markers with superior magnetic characteristics arranged transversely on the surface.

COMPARATIVE EXAMPLE 2

A continuous Fe-C film 50 m long was deposited in a thickness of 0.5 $\mu$m under the same conditions as in Example 4, except that the substrate was a polyethylene terephthalate film (UNITIKA, LTD.) that was set on a lead-on roll such that the direction in which it had the highest degree of thermal shrinkage formed an angle of 60° with the direction of travel.

The magnetic easy axis in the deposited thin Fe-C film formed an angle of 20° with the direction of substrate travel and an angle of 40° with the direction for the maximum thermal shrinkage of the substrate.

Figure 10:
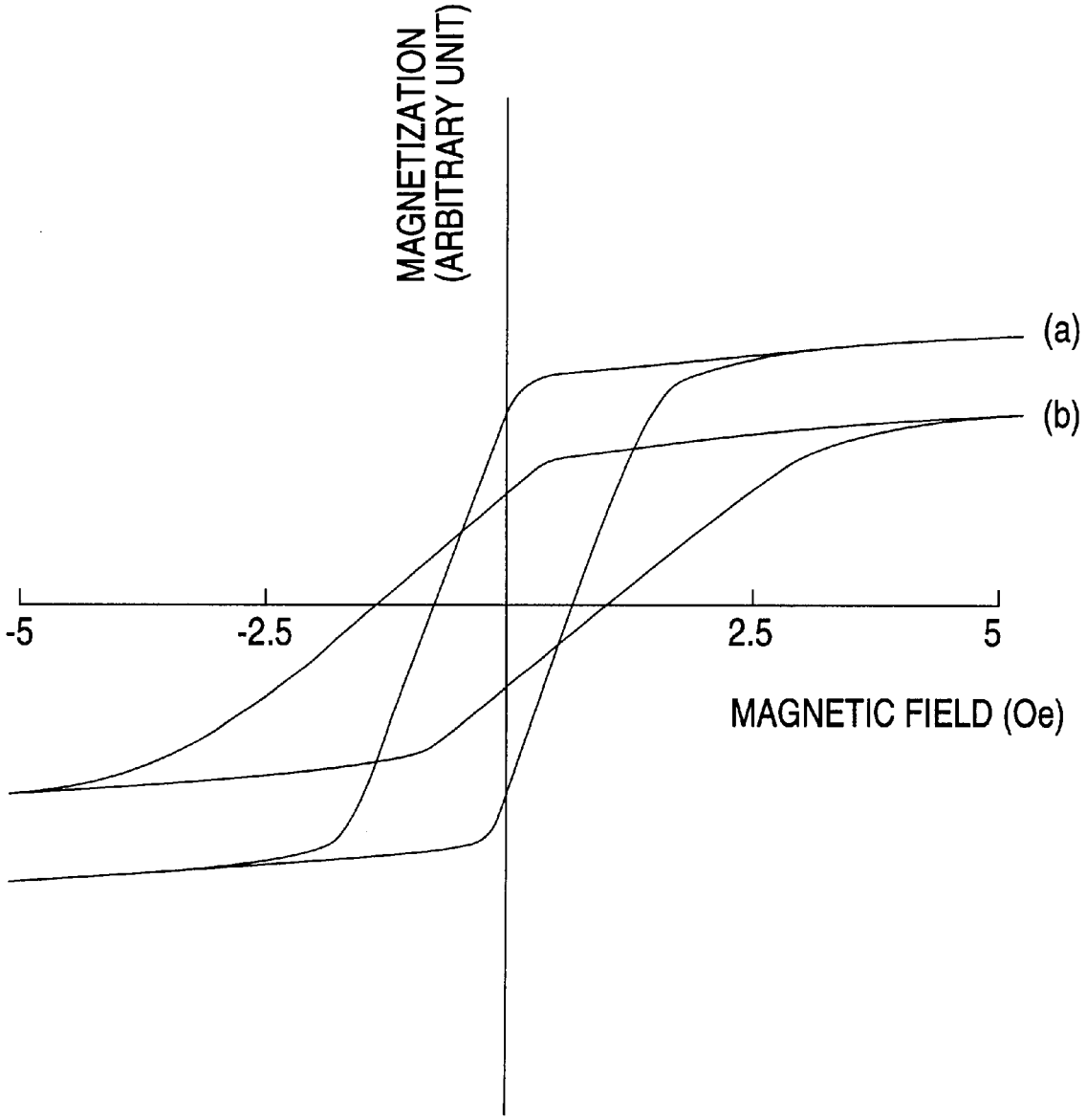
FIG. 10 shows two magnetization curves (a) and (b) for the thin film of Comparative Example 2 in the longitudinal and transverse directions.

The cyclic magnetic characteristics of the thin Fe-C film were measured as in Example 1. The results are shown in FIG. 10, which plots the applied magnetic field on the horizontal axis and the degree of magnetization on the vertical axis. Curve (a) shows the magnetization that developed in the longitudinal direction of the substrate, and curve (b) shows the magnetization in the transverse direction. As seen from FIG. 10, the magnetization did not change linearly with the applied field in either direction. It was therefore clear that the thin Fe-C film prepared in Comparative Example 2 did not acquire as high a degree of uniaxial magnetic anisotropy as the sample prepared in Example 4. It should also be mentioned that compared to the longitudinal direction of the substrate, the thin film did not have a magnetic easy axis in the transverse direction of the substrate.

For the ultimate purpose of obtaining a plurality of transversely arranged magnetic markers from the continuous thin Fe-C film, a sample 5 mm wide and 30 mm long was cut such that the sample width (as measured in the transverse direction) was oriented parallel to the longitudinal direction of the thin film (i.e., the direction of substrate travel). The pulse voltage that developed upon field application as in Example 1 were evaluated in terms of the voltage that was induced at a detection coil wound about the thin film. A pulsed voltage was not obtained under the stated conditions.

COMPARATIVE EXAMPLE 3

A continuous Fe-C thin film 50 m long was deposited in a thickness of 0.5 $\mu$m by repeating the procedure of Example 4, except that the thickness of the Fe-C thin film that was deposited as the result of a single pass of the substrate over the cathode was set at 0.5 $\mu$m. The target and the sputtering conditions were also the same as in Example 4.

The magnetic easy axis in the deposited thin Fe-C film formed an angle of 40° with the direction of substrate travel (i.e., the direction of its maximum thermal shrinkage).

Figure 11:
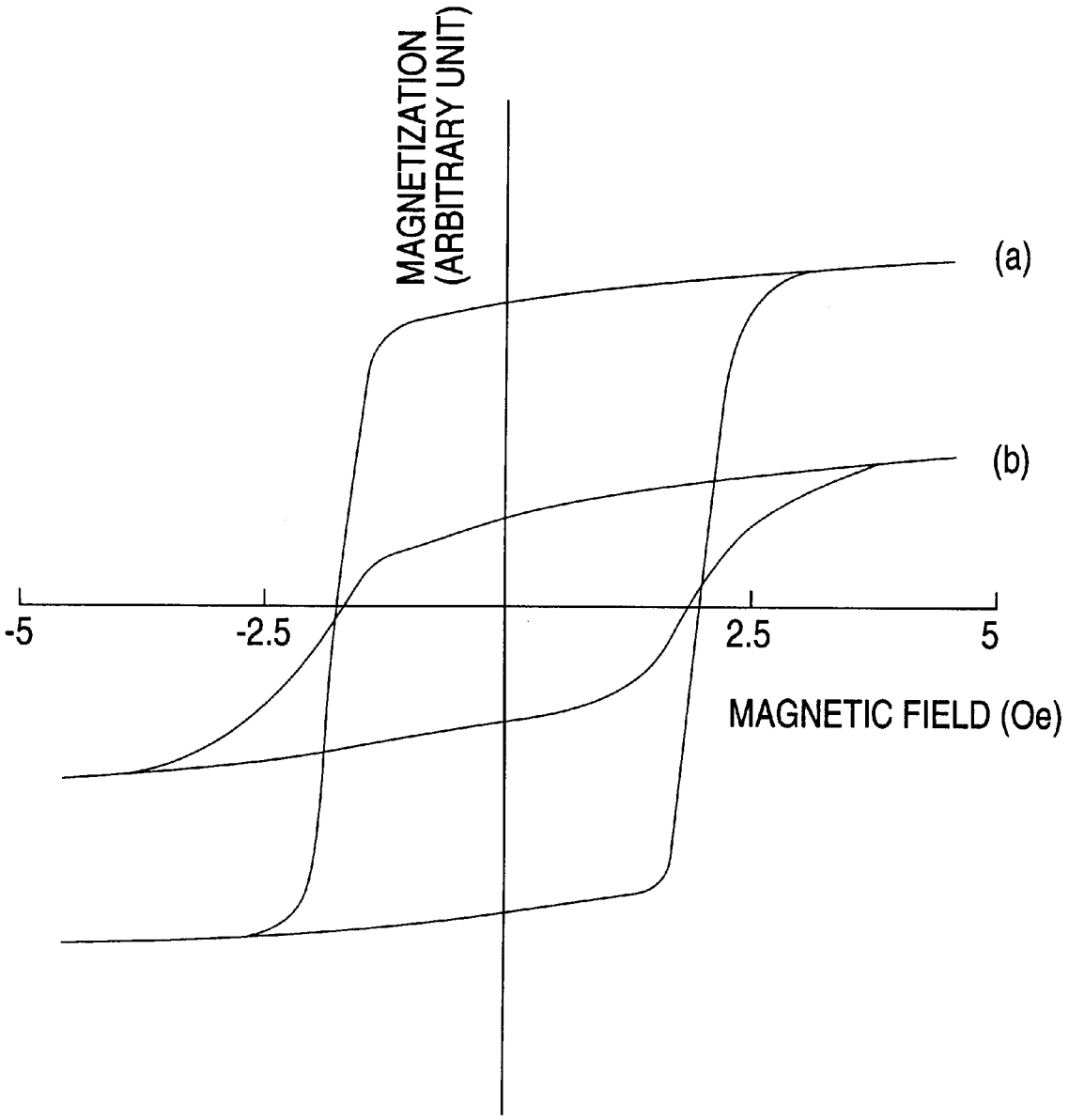
FIG. 11 shows two magnetization curves (a) and (b) for the thin film of Comparative Example 3 in the longitudinal and transverse directions of the substrate, respectively.

The cyclic magnetic characteristics of the thin Fe-C film were measured as in Example 1. The results are shown in FIG. 11, which plots the applied magnetic field on the horizontal axis and the degree of magnetization on the vertical axis. Curve (a) shows the magnetization that developed in the longitudinal direction of the substrate, and curve (b) shows the magnetization in the transverse direction. As seen from FIG. 11, the magnetization did not change linearly with the applied field in either direction. It was therefore clear that the thin Fe-C film prepared in Comparative Example 3 did not acquire as high a degree of uniaxial magnetic anisotropy as the sample prepared in Example 4. It should also be mentioned that the thin film exhibited poor soft magnetic characteristics as evidenced by a coercive force of 1.5 Oe in the longitudinal direction of the substrate. Moreover, a loop of high squareness ratio was not obtained.

The structure of the thin film was identified by the same method as in Example 1, and it exhibited not only a halo pattern characteristic of amorphous structures but also a sharp peak characteristic of crystal structures.

For the ultimate purpose of obtaining a plurality of transversely arranged magnetic markers from the continuous thin Fe-C film, a sample 5 mm wide and 30 mm long was cut such that the sample width (as measured in the transverse direction) was oriented parallel to the longitudinal of the thin film (i.e., the direction of substrate travel). The pulse voltage that developed upon field application as in Example 1 were evaluated in terms of the voltage that was induced at a detection coil wound about the thin film. A pulsed voltage was not obtained under the stated conditions.

While the invention has been described in detail and with reference to specific embodiments thereof it will be apparent to one skilled in the art that various changes and modifications can be made therein without departing from the spirit and scope thereof.

What is claimed is:

1. A magnetic marker comprising a flexible organic polymer substrate having thereon a soft magnetic thin film, wherein said organic polymer substrate has an anisotropic thermal shrinking property and said soft magnetic thin film has uniaxial magnetic anisotropy, and the angle formed between the direction in which said organic polymer substrate has the highest degree of thermal shrinkage and the direction of magnetic easy axis in said soft magnetic thin film is in the range of from 50° to 90°.

2. The magnetic marker as in claim 1, wherein the angle formed between the direction in which said organic polymer substrate has the highest degree of thermal shrinkage and the direction of magnetic easy axis in said soft magnetic thin film is in the range of from 60° to 90°.

3. The magnetic marker as in claim 1, wherein the angle formed between the direction in which said organic polymer substrate has the highest degree of thermal shrinkage and the direction of magnetic easy axis in said soft magnetic thin film is in the range of from 75° to 90°.

4. The magnetic marker as in claim 1, wherein the difference between maximum and minimum values for the degree of thermal shrinkage a that occurs in the organic polymer substrate as a result of heat treatment at 150° C. for 15 minutes ranges from 0.003 to 0.015.

5. The magnetic marker as in claim 1, wherein the substrate comprises polyethylene terephthalate.

6. The magnetic marker as in claim 1, wherein the substrate has a thickness of from 25 to 125 $\mu$m.

* * * * *